US010793390B2

(12) United States Patent
De Matteis

(10) Patent No.: US 10,793,390 B2
(45) Date of Patent: Oct. 6, 2020

(54) WEB OR SHEET CONVEYING UNIT FOR PAPER CONVERTING MACHINES AND FOLDING OR INTERFOLDING MACHINE WITH SUCH CONVEYING UNIT

(71) Applicant: M.T.C. MACCHINE TRASFORMAZIONE CARTA SRL, Porcari (IT)

(72) Inventor: Alessandro De Matteis, Lucca (IT)

(73) Assignee: M.T.C.—MACCHINE TRASFORMAZIONE CARTA SRL, Porcari (IT)

( * ) Notice: Subject to any disclaimer, the term of this patent is extended or adjusted under 35 U.S.C. 154(b) by 319 days.

(21) Appl. No.: 15/778,728

(22) PCT Filed: Dec. 19, 2016

(86) PCT No.: PCT/IB2016/057772
§ 371 (c)(1),
(2) Date: May 24, 2018

(87) PCT Pub. No.: WO2017/109670
PCT Pub. Date: Jun. 29, 2017

(65) Prior Publication Data

US 2018/0354741 A1 Dec. 13, 2018

(30) Foreign Application Priority Data

Dec. 23, 2015 (IT) ..... 102015000087107

(51) Int. Cl.
*B65H 20/10* (2006.01)
*B65H 45/24* (2006.01)
(Continued)

(52) U.S. Cl.
CPC ..... *B65H 45/24* (2013.01); *B65H 20/10* (2013.01); *B65H 20/28* (2013.01); *B65H 29/242* (2013.01);
(Continued)

(58) Field of Classification Search
CPC ..... B65H 20/10; B65H 20/28; B65H 29/242; B65H 45/16; B65H 45/20; B65H 45/24;
(Continued)

(56) References Cited

U.S. PATENT DOCUMENTS 3,490,762 A 1/1970 Nystrand
4,702,135 A 10/1987 Kwasnitza
(Continued)

FOREIGN PATENT DOCUMENTS

EP 1 457 444 A2 9/2004
EP 1 520 822 A2 4/2005
(Continued)

OTHER PUBLICATIONS

International Search Report, dated Apr. 13, 2017, corresponding to Application No. PCT/IB2016/057772.

*Primary Examiner* — Leslie A Nicholson, III
(74) *Attorney, Agent, or Firm* — Ladas & Parry, LLP; Malcolm J. MacDonald

(57) ABSTRACT

A conveying unit (100) of a web, or sheet, of paper, or similar products, arranged to transfer along a transfer direction the web, or sheet, of paper, having a support (41) having a lateral surface (42) provided with at least one peripheral suction groove (43). A suction belt (45) is arranged to move along a closed trajectory (46) comprising the suction portion (44). The suction belt (45) is configured to air-tightly engage the suction portion and provides at least one through hole (47) arranged to be positioned at a respective suction portion (43) in order to cause a suction effect on the web, or sheet,
(Continued)

and to transfer it from a first point P1 to a second point P2 of a production line of paper products. It is, furthermore, provided a driving device (60) configured to move the suction belt (45) with respect to the support (41).

19 Claims, 11 Drawing Sheets

(51) Int. Cl.
*B65H 29/24* (2006.01)
*B65H 45/20* (2006.01)
*B65H 20/28* (2006.01)
*B65H 45/16* (2006.01)

(52) U.S. Cl.
CPC ..... *B65H 45/16* (2013.01); *B65H 45/20* (2013.01); *B65H 2301/3422* (2013.01); *B65H 2404/2222* (2013.01); *B65H 2404/25* (2013.01); *B65H 2404/2531* (2013.01); *B65H 2404/264* (2013.01); *B65H 2406/3223* (2013.01); *B65H 2406/32231* (2013.01)

(58) Field of Classification Search
CPC .... B65H 2301/3422; B65H 2404/2222; B65H 2404/25; B65H 2404/2531; B65H 2404/264
USPC ..... 270/39.01, 39.05
See application file for complete search history.

(56) References Cited

U.S. PATENT DOCUMENTS

| | | | | |
|---|---|---|---|---|
| 7,517,309 | B2 * | 4/2009 | De Matteis | B65H 45/24 493/411 |
| 8,602,198 | B2 * | 12/2013 | Coenen | B65H 18/06 193/37 |
| 8,939,445 | B2 * | 1/2015 | Schoultz | B65H 45/16 271/108 |
| 9,004,480 | B2 * | 4/2015 | Hsu | B65H 45/24 270/39.02 |
| 9,388,016 | B2 * | 7/2016 | De Matteis | B65H 45/24 |
| 9,624,063 | B2 * | 4/2017 | Coenen | B65H 45/12 |
| 10,167,159 | B2 * | 1/2019 | Ingole | B65H 27/00 |
| 2008/0264279 | A1 * | 10/2008 | Shimizu | B65H 29/242 101/227 |

FOREIGN PATENT DOCUMENTS

| | | | |
|---|---|---|---|
| EP | 1 630 118 | A1 | 3/2006 |
| JP | H03107447 | A | 5/1991 |

* cited by examiner

Fig. 2
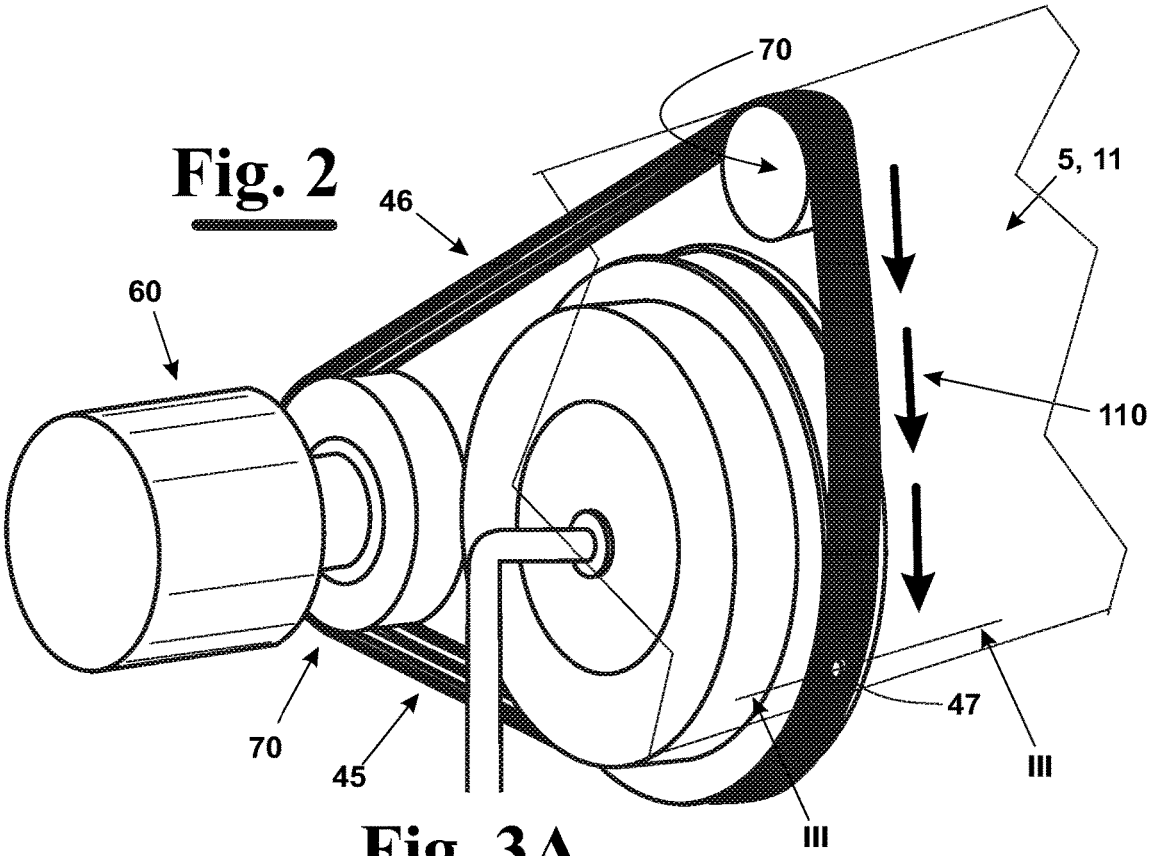
Fig. 3A
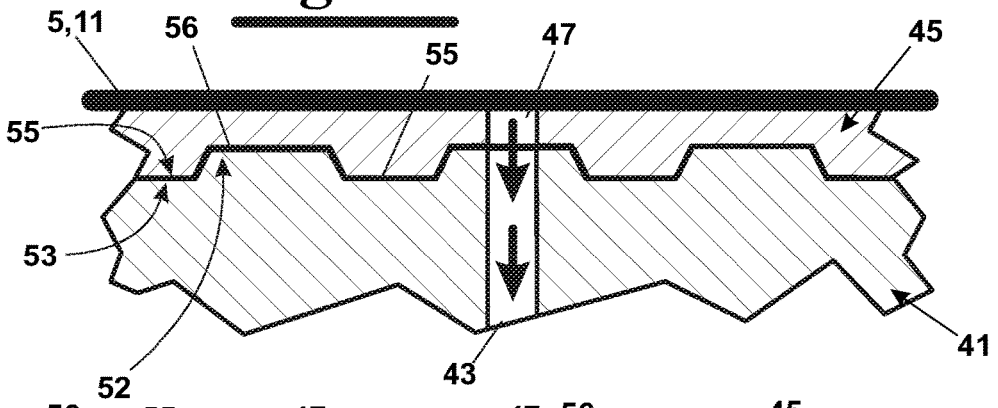
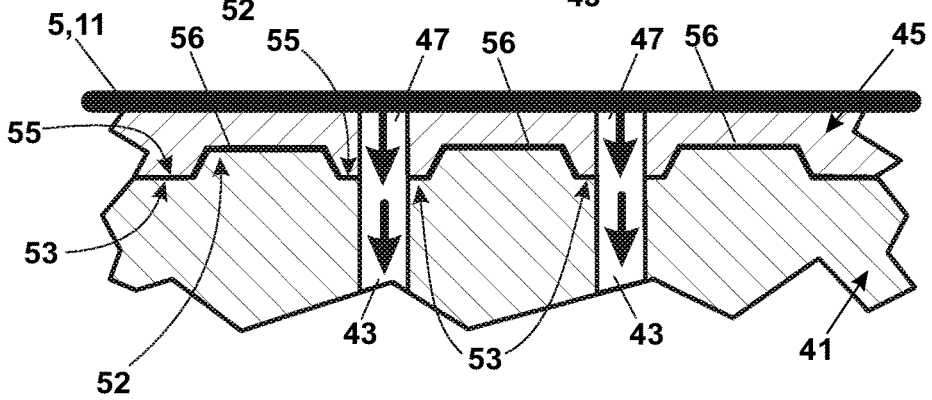
Fig. 3B

WEB OR SHEET CONVEYING UNIT FOR PAPER CONVERTING MACHINES AND FOLDING OR INTERFOLDING MACHINE WITH SUCH CONVEYING UNIT

FIELD OF THE INVENTION

The present invention relates to the production of articles made of paper into stacks of sheets, for example sheets that are simply folded or interfolded, and it relates, in particular, to a web or sheet conveying unit for paper converting machines.

Furthermore, the invention relates to a structure of folding and stacking machine of such sheets that uses such conveying unit.

BACKGROUND OF THE INVENTION

As well known, in the paper industry, different types of machines and processes exist for producing paper tissues, towels and similar articles into stacks of sheets of a determined height.

The stacks can be produced by folding the sheets in an "interfolded" way, i.e. at each fold a wing of the previous sheet and a wing of the next adjacent downstream sheet are overlapped to each other. In the interfolded way, when a sheet is extracted from the stack, at the moment of the use, also a wing of the next adjacent downstream sheet is extracted, with subsequent ease for certain types of users.

Among the different possible way to fold the sheets, the L-type, with 2 panels (single-fold), or the Z, or W types, respectively with 3 and 4 panels (multi-fold) are known.

The folding machines use one or more webs of paper coming from one or more rolls cut into sheets and fed shifted from each other on counter-rotating folding rollers. More precisely, the cut of the webs into sheets is carried out on cutting rollers, which alternately interact with respective counter-blades.

In case of L-type interfolding, obtained by "single-fold" machines, as for example described in U.S. Pat. No. 6,228,014, the two webs coming from two different directions, are cut in such a way to form two shifted successions of sheets that are alternately fed to the folding rollers. In this way, once the fold is carried out, about half sheet of each sheet coming from a first direction is overlapped with a portion of the sheet coming from a second direction, and vice-versa.

In case of Z-type or W-type interfolding, or in case of even more panels, produced by "multi-fold" machines, as for example described in U.S. Pat. No. 3,490,762, a single web is generally fed, and a stream of already partially overlapped sheets reaches, from a single direction, the folding rollers. The overlapping of two successive sheets happens immediately after the cut, as described in EP1520822, by means of a transfer roller and a retard roller, which together produce a bend in an upstream sheet, under which, the downstream sheet partially overlaps.

Both in the single-fold and in the multi-fold machines, in order to continuously fold the sheets, the folding rollers of prior art have a circumference that is a multiple of the length of a folded panel. Furthermore, the folding rollers of prior art provide devices for holding the sheet, or web, of paper, such as suction holes, or mechanical clamps, that are synchronously and alternately operated for starting and completing each fold of two successive panels on each other.

For example, EP1457444B1 discloses conveying and folding rollers having suction holes, with a first series of suction holes holding the sheets on a folding roller for a determined angular distance, and then "delivering" it to the other folding roller, also having a parallel holding device with suction holes, which works for another predetermined angular distance. Through this controlled "delivery" of the sheets, or web, of paper, from a folding roller to another, a desired folding, or interfolding, configuration is carried out, obtaining a stack of folded, or interfolded, sheets.

The "panel length", which determines the width of the stack of folded sheets exiting the machine, is a submultiple of the circumferential development of the folding rollers, and, therefore, it is one of the main structural constraints of the folding machines, that prevents from changing the length of the panels without completely changing the folding rollers.

In EP1630118, in the name of the same Applicant, an interfolding machine is described having a framework, which comprises a folding section where the sheets are fed to the folding rollers shifted from each other, and then folded in such a way to obtain a predetermined interfolding configuration. The folding section provides a structure of modular type comprising a portion that can be removed in order to be exchanged with an equivalent portion, but capable of working with a different panel length.

Notwithstanding the solution described in EP1630118, which is capable of giving to the machine a certain versatility, a long time is required for changing a module with another equivalent module with a loss of productivity. Furthermore, it is necessary to have wide areas available where it is possible to position the different modules that are not installed in the machines. The different modules have, in fact, a considerable encumbrance.

It is also known that, in many industrial fields, machines are provided with conveying rollers for conveying the webs, or sheets, of paper, or similar thin materials, where the conveying rollers have peripheral holes for applying the suction, which determines an adhesion of the webs, or the sheets, to the roller surface for a predetermined conveying angle. The modification of the pitch between the holes, for example in order to transfer sheets of different length, needs, however, that the roller is exchanged with another roller having suction holes with a different pitch, and, therefore, different diameter, with considerable production problems, for the long stops that are needed. In order to reduce the duration of the stops, for example, EP1826165 describes a system for replacing groups of rollers for changing the cut-off parameter, i.e. the length of each sheet.

SUMMARY OF THE INVENTION

It is therefore an object of the present invention to provide an improved structure of sheet folding and stacking machine, which is highly versatile and, in particular, able to produce stacks of folded sheets with panels having different length.

It is also an object of the present invention to provide a similar structure of sheet folding and stacking machine that is able to change very quickly the length of the panels.

It is a particular object of the present invention to provide a folding and stacking machine that is constructively easier and less encumbering than similar machines of prior art, for producing stacks of interfolded sheets with a panel length that can be changed.

These and other objects are achieved by a folding and stacking machine, according to the present invention, comprising:

- a folding, or interfolding, section, arranged to fold, or interfold, a web of paper, or a plurality of sheets of paper, into a plurality of panels according to a predetermined folding, or interfolding, configuration;

whose main characteristic is that said folding, or interfolding, section, comprises:

a first and a second support facing each other in a central zone and having respective lateral surfaces provided with at least one peripheral suction groove extending on said lateral surface for a predetermined length, said, or each, peripheral suction groove pneumatically connected to an air suction system, in such a way to define a corresponding suction portion on the lateral surface of the respective support;

a first and a second suction belt arranged to move respectively along a first and a second closed trajectory, said first and second closed trajectory comprising, respectively, said suction portions of said first and second support, said first and second suction belt configured to air-tightly engage with said suction portions and providing at least one through hole arranged to be positioned at a respective suction portion in order to cause a suction effect on said web, or said sheets;

a driving device configured to move said first and second suction belt with respect to said support, in such a way that said through holes of one, or the other, belt are positioned at said central zone shifted from each other.

In this way, each belt slides air-tightly on a peripheral groove closing the respective suction portion, producing a pneumatic vacuum under the belt. The vacuum is transmitted to the web, or sheet, that is in contact with the belt, and therefore there is a perfect adhesion of the sheet, or web thereon. The belts are positioned on respective supports in such a way that, at a central line, the sheet, or web, is withdrawn from one, or the other belt, like the folding rollers of prior art. In practice, the belts are initially positioned in such a way that the holes of the two respective belts are shifted at a distance from each other corresponding to a panel length, in the conveying direction of the sheets. This way, by changing the length of the belts, it is possible to change the distance between the holes of a same belt, changing the width of the panel of the folding/interfolding machine.

Preferably, each support is a fixed support. In this way, a considerable structural simplification is obtained with respect to a folding section of prior art, since less moving parts and components are provided.

Alternatively, each support can be arranged to be movable, in particular, in the case each support is substantially cylindrical-shaped, it can be arranged to rotate ad a predetermined speed about a rotation axis.

Preferably, each suction belt provides a predetermined number of rows of through holes.

In particular, each suction belt can provide a plurality of rows of through holes. In this way, it is possible to make more folds at each complete turn of a belt. It is therefore possible to design belts with a length that allows to avoid that the positioning of the different parts of the machine, by the respective motorization, can be obstructed.

In particular, each row can comprise, in turn, a plurality of through holes. This technical solution allows, in particular, to carry out a more effective suction of the web, or sheet, by the belt.

More precisely, in the case of suction belts used in a folding section, the distance between two successive rows of through holes, i.e. the pitch of the rows of through holes, is substantially equal to the double of the length of a panel.

In a possible embodiment, the first and the second support have a substantially circular cross section and the length of the, or each, peripheral suction groove is arranged to define a suction portion extending for a predetermined angular width $\alpha$, in particular set between 30° and 120°.

In particular, each suction portion of the lateral surface is pneumatically connected to a respective suction chamber. More precisely, each suction chamber is, advantageously, housed in a respective support and is pneumatically connected to a vacuum pump.

Preferably, each suction belt is a toothed belt comprising a plurality of teeth alternated to a plurality of recesses. More precisely, the plurality of teeth is arranged to engage with a corresponding plurality of recesses made on the lateral surface of the respective support. Analogously, each recess of said plurality is arranged to engage with a corresponding protrusion of said plurality of protrusions made on the lateral surface of the respective support. This technical solution allows to constrain the belt to the support, in such a way to accurately guide the belt same, during its movement along the above described trajectory, and to improve the air-tight engagement.

In particular, at least one portion of the surface of said, or each, support can be the external surface of a bearing. In this way, it is possible, in use, to reduce the friction at contact points of the suction belt with the external surface of the support, thanks to the presence of the bearing.

Advantageously, at the lateral surface of the support at least one bearing is provided arranged, in use, to reduce the friction and to avoid, therefore, the a sliding engagement of the suction belt on the support surface. In particular, the friction reduction between the support and the belt allows to considerably reduce the friction of the components in play and, therefore, their half-life, besides reducing the energy consumption.

Preferably, the, or each, peripheral suction groove can be provided at a respective protrusion of said lateral surface of said support.

Alternatively, the, or each, peripheral suction groove can be made at a respective recess of said lateral surface of said support.

Advantageously, each support can provide:

a first suction group comprising at least one peripheral suction groove positioned at a predetermined distance from ends of said support, said first suction group defining a first suction portion on said surface of said support;

a second suction group comprising at least one suction groove positioned at a different distance from ends of the support, with respect to said, or each, peripheral suction groove of said first group, said second suction group defining on said surface of said support a second suction portion different from said first suction portion, said first and second suction portions partially overlapped to each other.

In particular, a plurality of suction belts can be provided, having a different pitch, for example stored in a storage housing available for the machines, namely with a different distance between two successive rows of suction holes, provided on said suction belts. The different suction belts are arranged to be selectively installed at the folding, or interfolding, section, i.e. mounted on the support, for processing panels of different length corresponding to half of the pitch between the holes, and, therefore, to obtain folded sheets with panels of different length.

In other words, in order to change the panel length, it is sufficient to stop the production of the machines, to replace the current suction belts with similar suction belts having the pitch between the holes equal to the double of a new panel length, i.e. the stack width. Furthermore, in general, it is necessary to automatically, or manually, adjust the supplemental folding and separation members, as for example the folding fingers, the containing guides of the stack, and the separation combs, in addition to adjust the cutting group, or cut-off, where it is necessary.

In particular, the machine can comprise, furthermore, a feeding section capable of feeding at least one web of paper, at a predetermined conveying speed, to said folding section.

Advantageously, the folding, or interfolding, machine, comprises, furthermore:

- a cutting section arranged to cut said, or each, web of paper into a plurality of sheets having a predetermined length;
- a transfer section arranged to transfer to said folding, or interfolding, section, said plurality of sheets that have been cut in the cutting section.

Advantageously, the cutting section comprises at least one cutting roller, on which at least one blade operates arranged to divide the web of paper into a plurality of sheets having a predetermined length.

Alternatively to the cutting section, the machine can provide a perforating section arranged to perforate said, or each, web of paper without dividing it into sheets. More in detail, the perforating section is capable of making the perforation lines on the processed web of paper at a predetermined distance from each other. In this case, downstream of the perforation section, a tearing section is provided that is arranged to divide said web of paper, provided with said perforations, into a plurality of sheets.

In particular, in the transfer section, at least one transfer roller can be provided having holding members arranged to hold the cut sheets in the cutting section and to transfer them directly to the folding, or interfolding, section.

Advantageously, the transfer section comprises, furthermore, at least a first and a second transfer belt. More in detail, each transfer belt is arranged to receive the sheets from the transfer roller and to transfer them to a respective suction belt of the folding, or interfolding, section.

Advantageously, it is possible to provide a separation section, at which separation members can be provided that is arranged to enter into the stack, once completed, and to separate the same from a successive forming stack.

According to another aspect of the invention, a conveying unit of a web, or sheet, of paper is provided that is arranged to transfer along a transfer direction of a paper converting machine, the web, or the sheet, of paper, and comprises:

- a support having a lateral surface provided with at least one peripheral suction groove extending for a predetermined length, said, or each, peripheral suction groove pneumatically connected to an air suction system, in such a way to define a corresponding suction portion on the lateral surface of the support;
- a suction belt arranged to move along a closed trajectory comprising the suction portion, said suction belt is configured to air-tightly engage with said suction portion and providing at least one through hole, arranged to be positioned at a respective suction groove for causing a suction on the web, or the sheet, and for transferring the same from a first to a second point of a production line for producing paper, or linear products, obtained starting from said web, or sheet;
- a driving device arranged to move said belt with respect to said support.

BRIEF DESCRIPTION OF THE DRAWINGS

Further characteristics and the advantages of the invention will be made clearer with the following description of some exemplary embodiments thereof, exemplifying but not limitative, with reference to the attached drawings, in which:

FIGS. 2, 4, 5, 6 and 10 show in perspective side views, some possible alternative embodiments of the conveying unit of FIG. 1;

FIG. 3A diagrammatically shows a cross section along arrows III-III of the conveying unit of FIG. 2;

FIG. 3B diagrammatically shows a cross section along arrows III-III of an alternative embodiment of the conveying unit of FIGS. 2 and 3A;

FIGS. 8, 9A, 9B and 10 diagrammatically show some possible embodiments of the support used in the conveying unit, according to the present invention;

Figs. from 14 to 16 diagrammatically show some embodiments of the machine for holding the paper using the transfer unit according to the invention in the folding, or interfolding, section.

DESCRIPTION OF A PREFERRED EXEMPLARY EMBODIMENT

Figure 1:
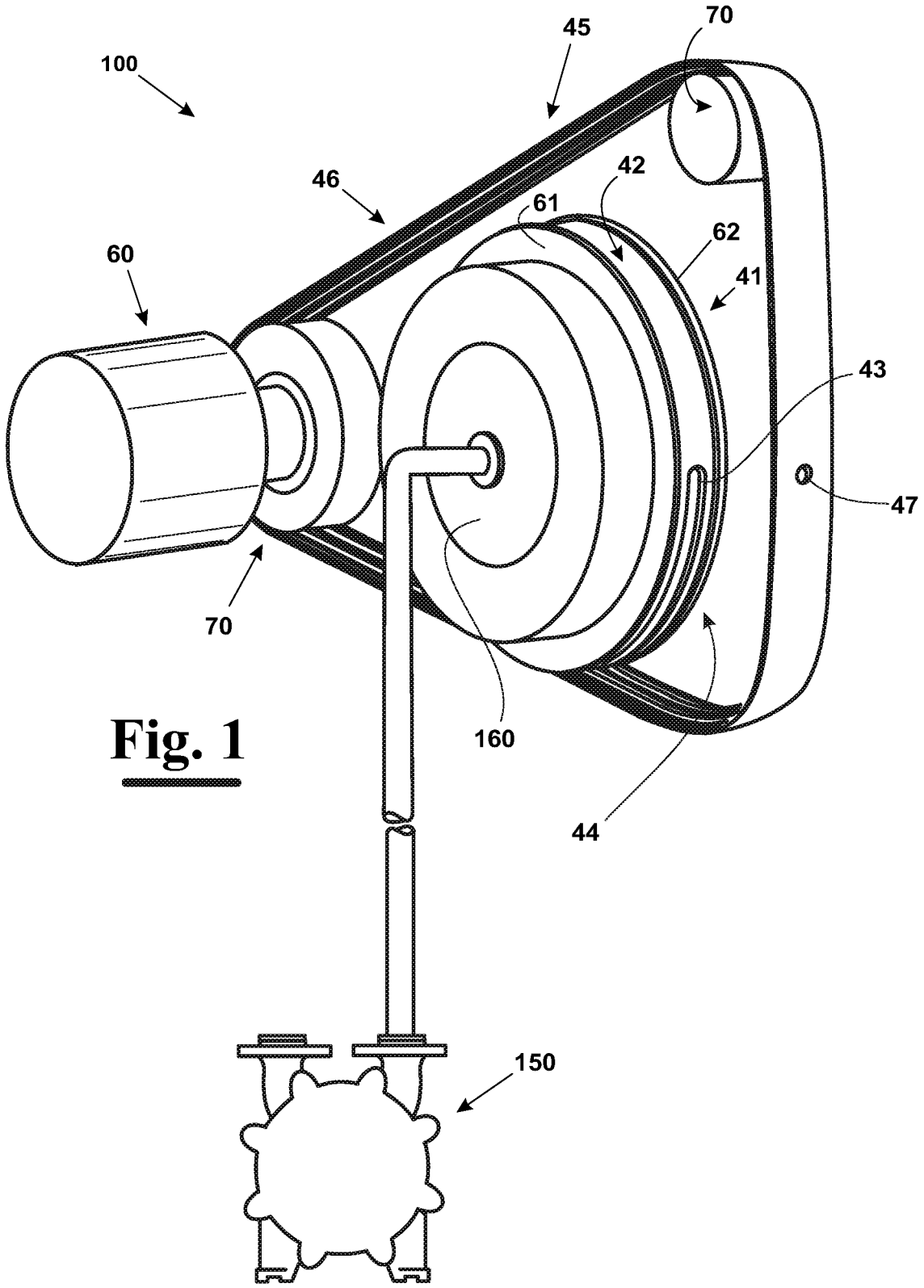
FIG. 1 diagrammatically shows in a perspective side view a first embodiment of a conveying unit, according to the invention, of a web, or sheet of paper in a paper converting machine.

With reference to FIGS. 1 and 2, a conveying unit 100 of a web 5, or sheet 11, of paper is provided that is arranged to transfer along a transfer direction 110 (see FIG. 2) web 5, or sheet 11, of paper, and comprises at least one support 41 having a lateral surface 42 provided with at least one peripheral suction groove 43 extending for a predetermined length. The, or each, peripheral suction groove 43 is pneumatically connected to an air suction system 150, in such a way to define a corresponding suction portion 44 on lateral surface 42. In particular, suction system 150, which comprises, for example, a vacuum pump, is pneumatically connected to a suction chamber 160, in particular housed in support 41.

Figure 15:
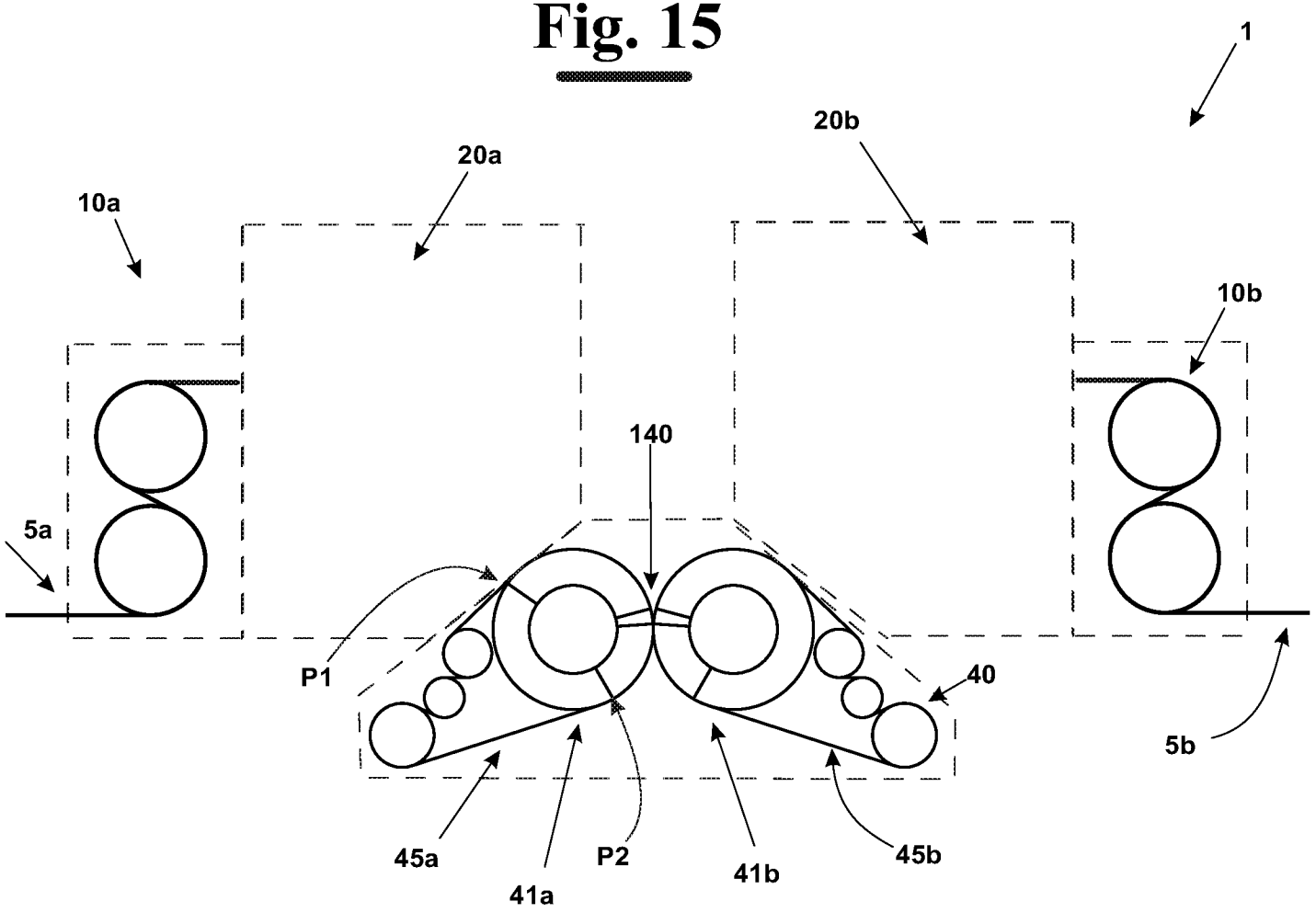
Figure 16:
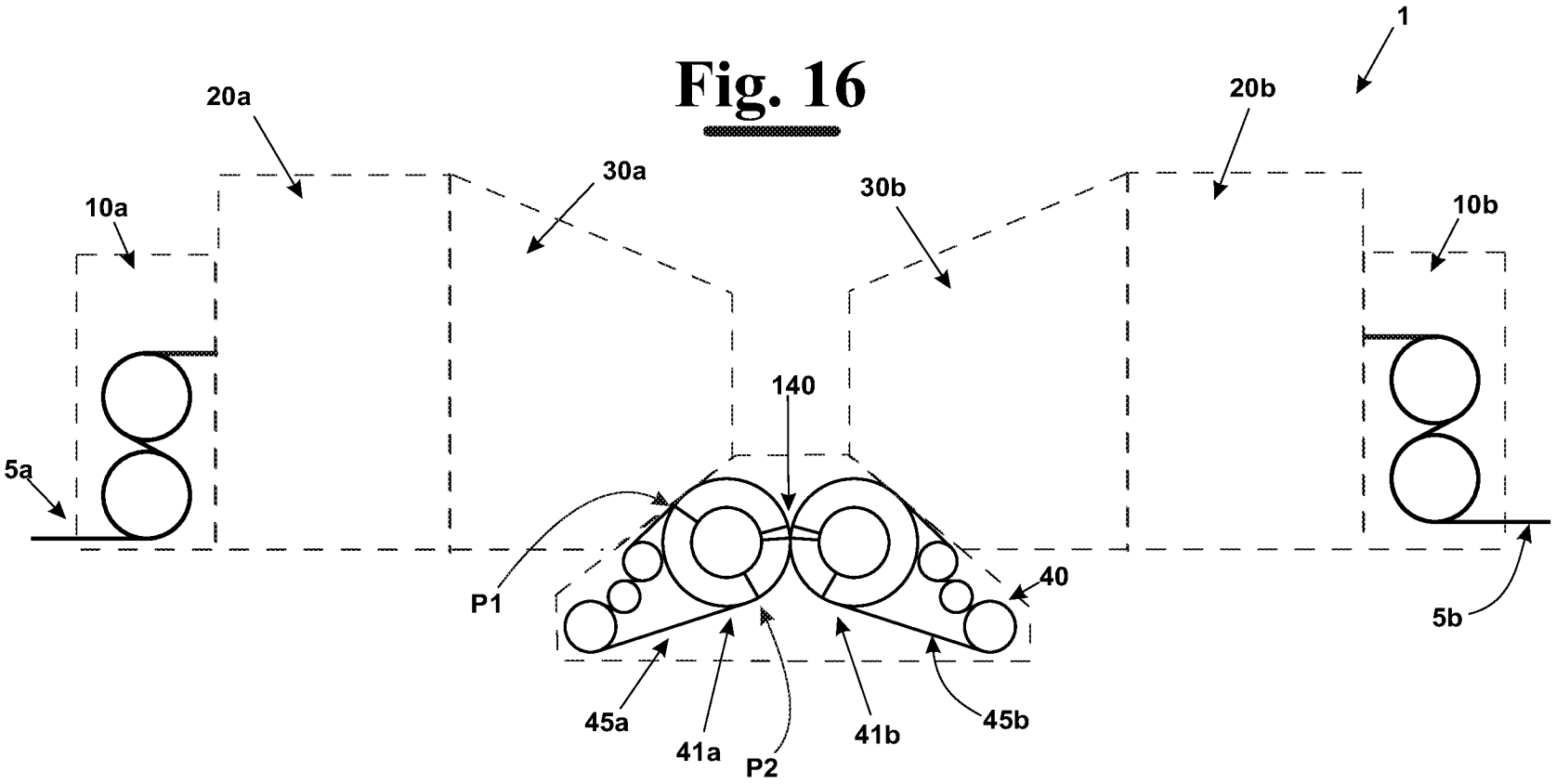

Device 100, according to the invention, comprises, furthermore, a suction belt 45 arranged to move along a closed trajectory 46 comprising suction portion 44. More in detail, suction belt 45 provides at least one through hole 47, arranged to be positioned at a respective suction groove 43 for causing a suction on web 5, or sheet 11, and for transferring it from a first point P1 to a second point P2 of a paper converting machine 1 (FIGS. 15 and 16). Conveying unit 100 comprises, furthermore, a driving device 60 comprising, for example, a motor and a determined number of transmission members, arranged to move belt 45 with respect to support 41. In particular, a predetermined number of pulleys 70 can be provided, by means of which the above described trajectory is defined.

Suction belt 45 is, generally, equipped with a predetermined number of rows of through holes 47. For example, in the embodiment of FIG. 1, suction belt 45 has a single hole 47 and support 41 has a single peripheral groove 43. In particular, in the case of a folding unit 40 equipped with the conveying unit, according to the invention, each belt 45*a*, 45*b* advantageously provides at least two holes.

Figure 4:
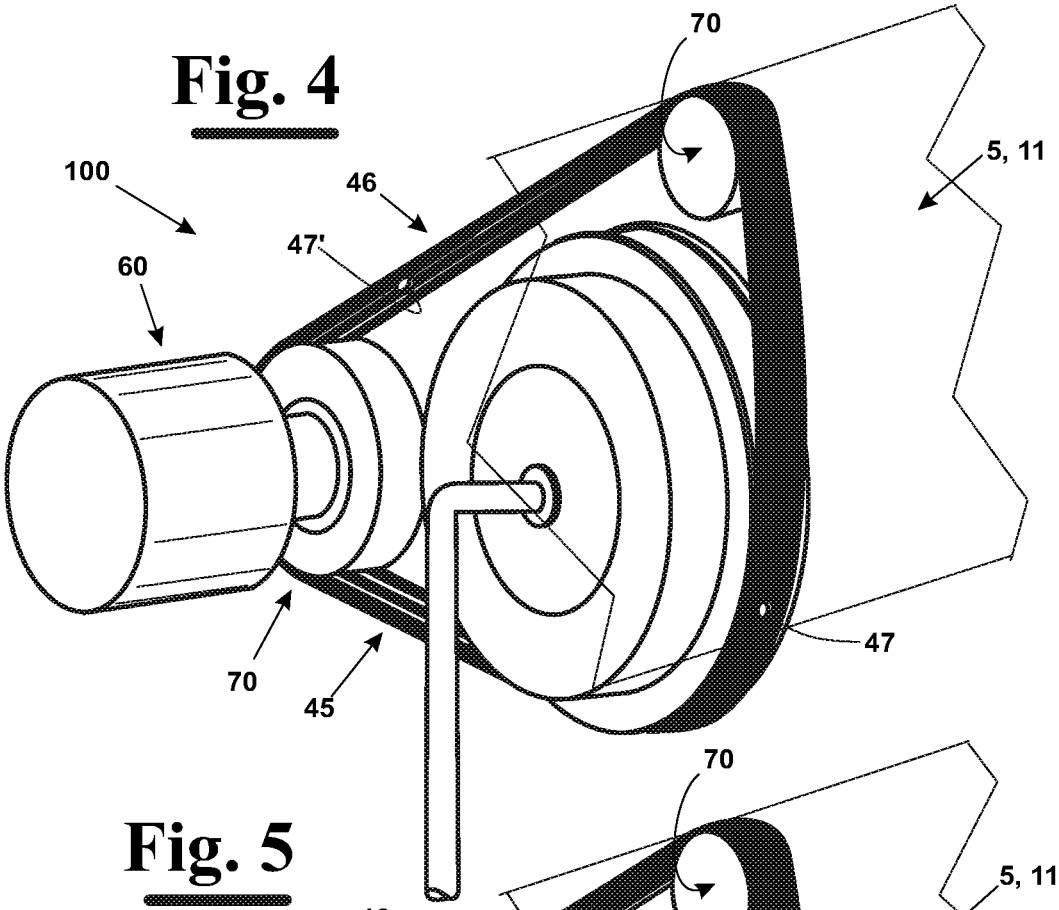
Figure 5:
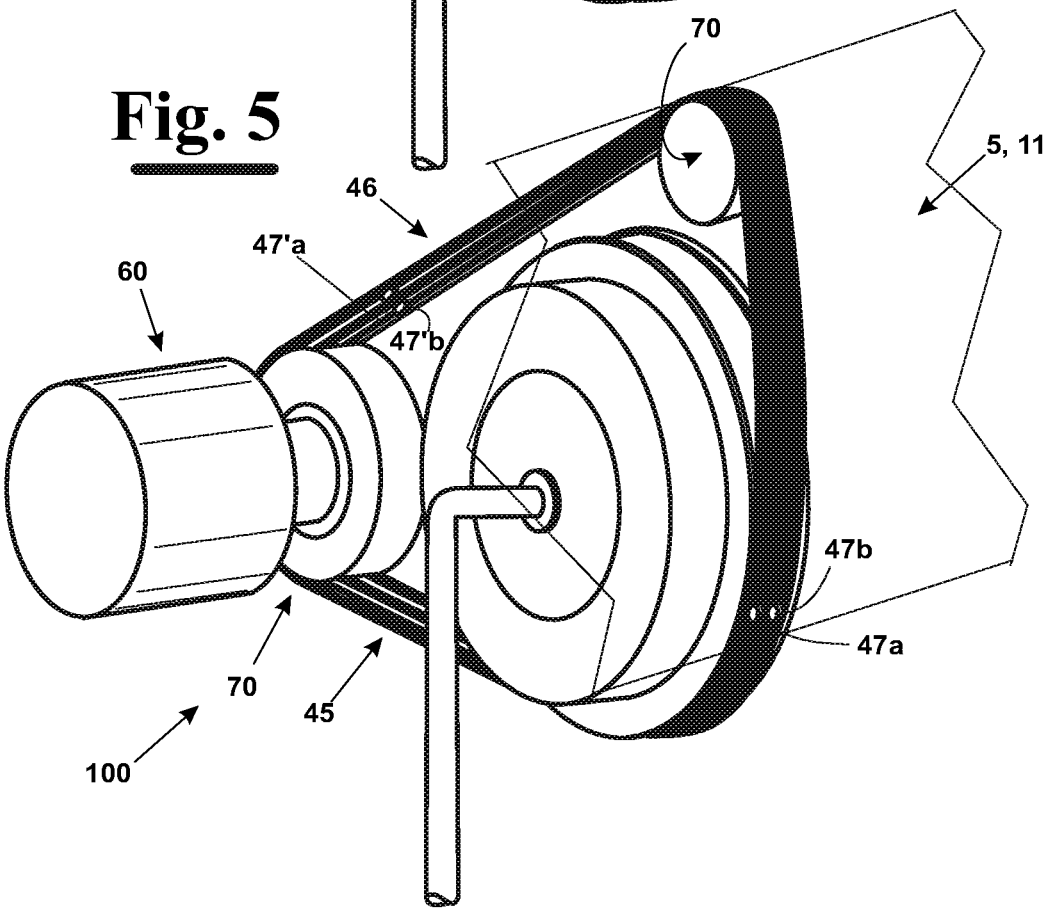
Figure 14:
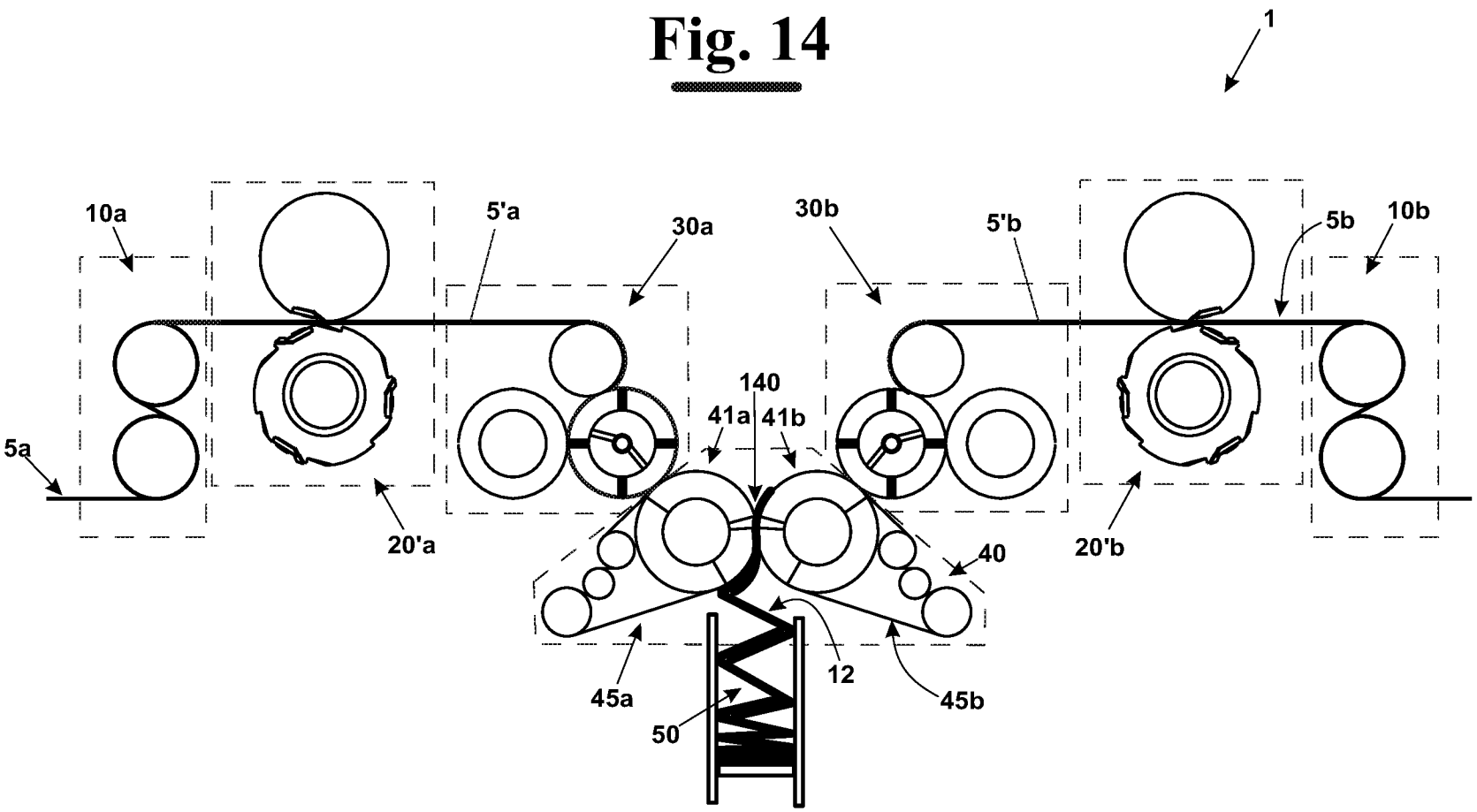

In general, however, suction belt 45 can provide at least a first and a second suction hole 47 and 47' positioned at a predetermined distance from each other, and arranged to selectively cause a suction effect on web 5, or the sheet of paper 11 (FIG. 4). More precisely, the distance between two suction holes 47 and 47' corresponds, in the case of a conveying unit, to the length of the sheets 11 that are processed by the machine 1, or, in the case of a folding unit, to the double of the length of the panels 12 of the sheets 11 (FIG. 14). In a further possible embodiment, belt 45 provides a plurality of rows of holes, each row of holes comprising a plurality of holes, for example two rows of holes, each comprising two holes 47*a*, 47*b* and 47'*a*, 47'*b* (like FIG. 5). In general, the distance between two rows of successive holes is substantially equal to the length of the sheet. Instead, when two conveying units 100 are provided, in order to be symmetric, at the folding section 40, the distance between two successive rows of holes 47 of each belt 45*a* and 45*b* is equal to the double of the panel length 12.

Figure 6:
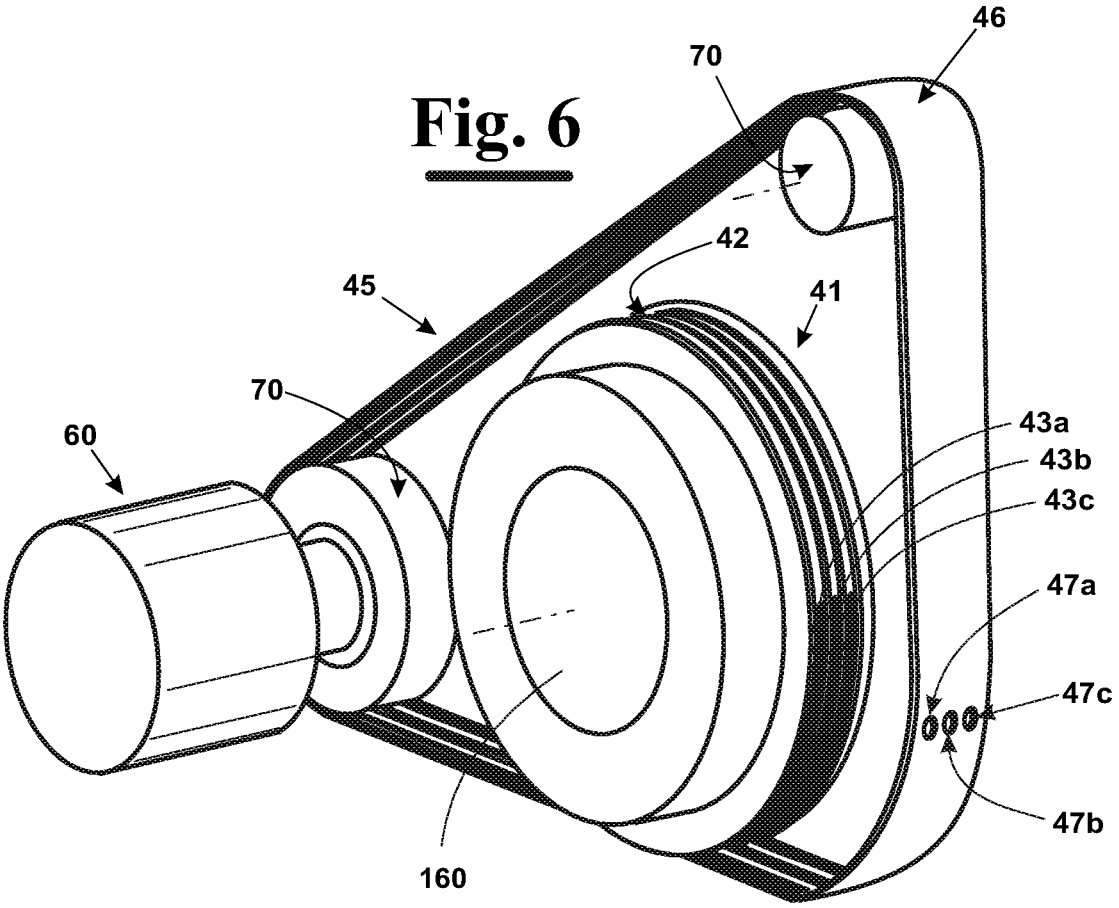

In the alternative embodiment of FIG. 6, each row of holes comprises three holes 47*a*, 47*b* and 47*c*. In particular, the number of holes for each row of holes is chosen on the basis of the width of support 41, or according to another specific need of the process.

Figure 8:
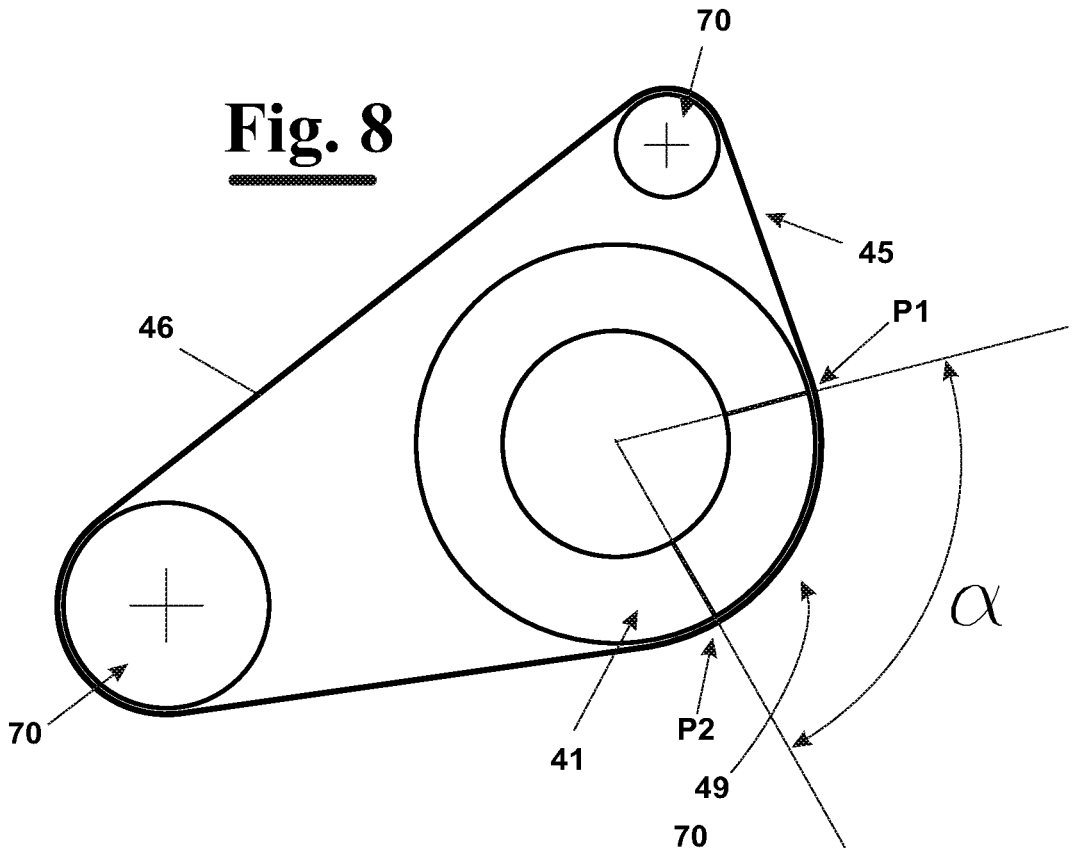
Figure 9A:
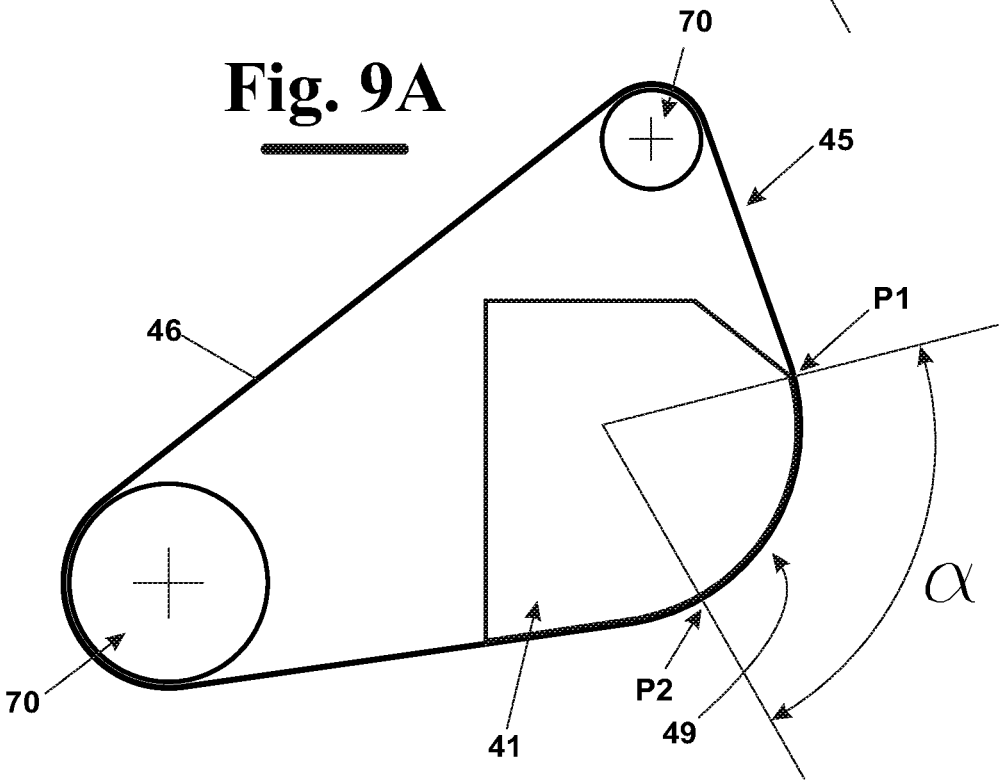
Figure 9B:
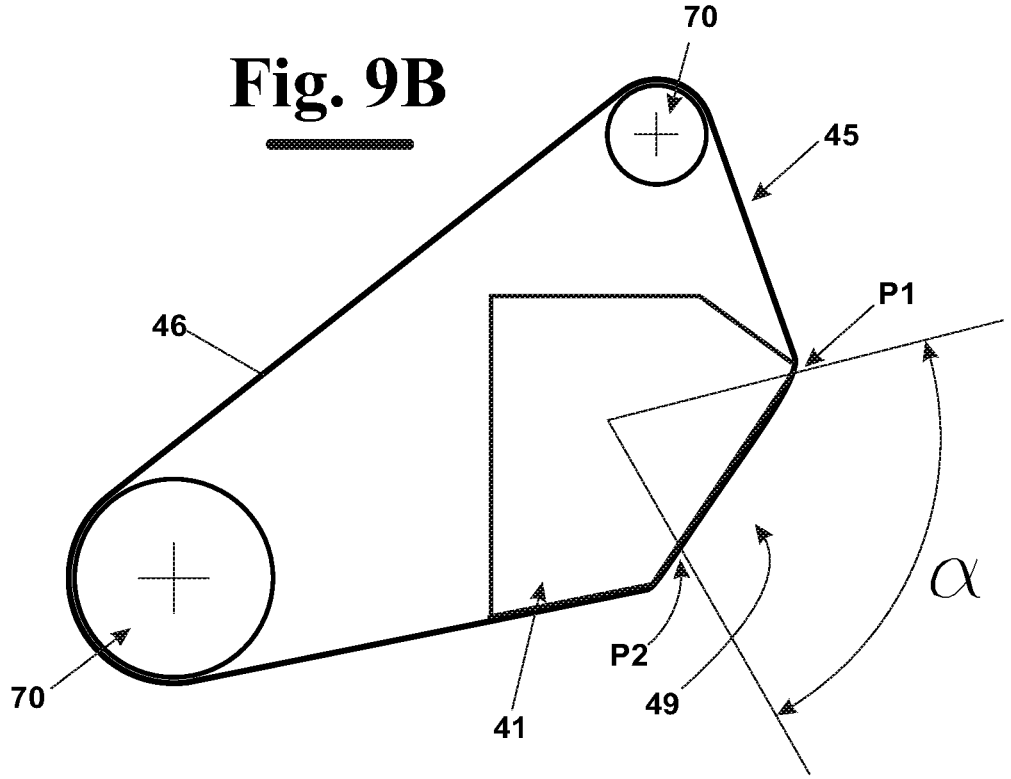

In FIGS. 8, 9A, and 9B, some possible embodiments for support 41 are shown. More in detail, in the embodiment of FIG. 8, support 41 has a substantially circular cross section, whereas in the alternative embodiment of FIG. 9A, support 41 has a cross section, which comprises some rectilinear portions and some curvilinear portions. At one end, in the alternative embodiment of FIG. 9B, the cross section of support 41 is exclusively formed by rectilinear portions, connected, if necessary, by a curvilinear edge, in order to avoid feather-edges. In general, therefore, support 41 can have substantially any shape.

Figure 7:
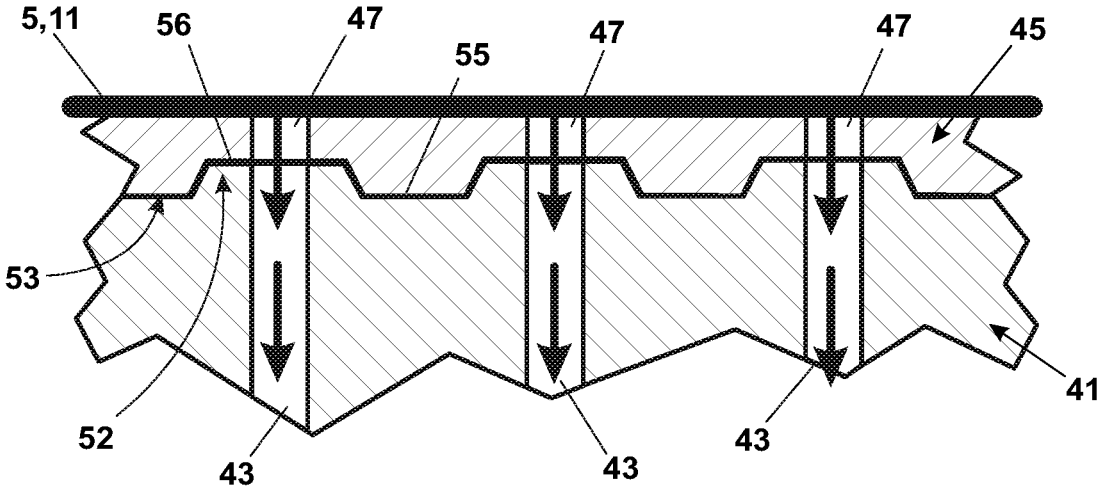
FIG. 7 shows a partial cross section of the conveying unit of FIG. 6.

As shown in detail, for example in FIGS. 3A, 3B and 7, suction belt 45 can be a toothed belt, i.e. it provides a plurality of teeth 55 alternated to a plurality of recesses 56.

More precisely, the plurality of teeth 55 of belt 45 is arranged to engage with a corresponding plurality of recesses 53 made on lateral surface 42 of support 41. Analogously, each recess 56 of belt 45 is arranged to engage with a corresponding protrusion 52 of lateral surface 42 of support 41.

As shown in FIG. 3A, the, or each, hole 47 can be made at least at a recess 56. In this case the, or each, peripheral groove 43 is made at the protrusion 52 that is arranged to engage the recess 56 of belt 45.

In the example of FIG. 3B, instead, the, or each, hole 47 is made at least at a protrusion 55 of belt 45. In this case the, or each, peripheral groove 43 is, therefore, made at the recess 53 that is arranged to engage the protrusion 55 of belt 45. As shown in FIG. 7, it can be also provided that holes 47 are made both at one, or more, protrusions 55 and at one, or more, recesses 56 of belt 45.

Figure 12:
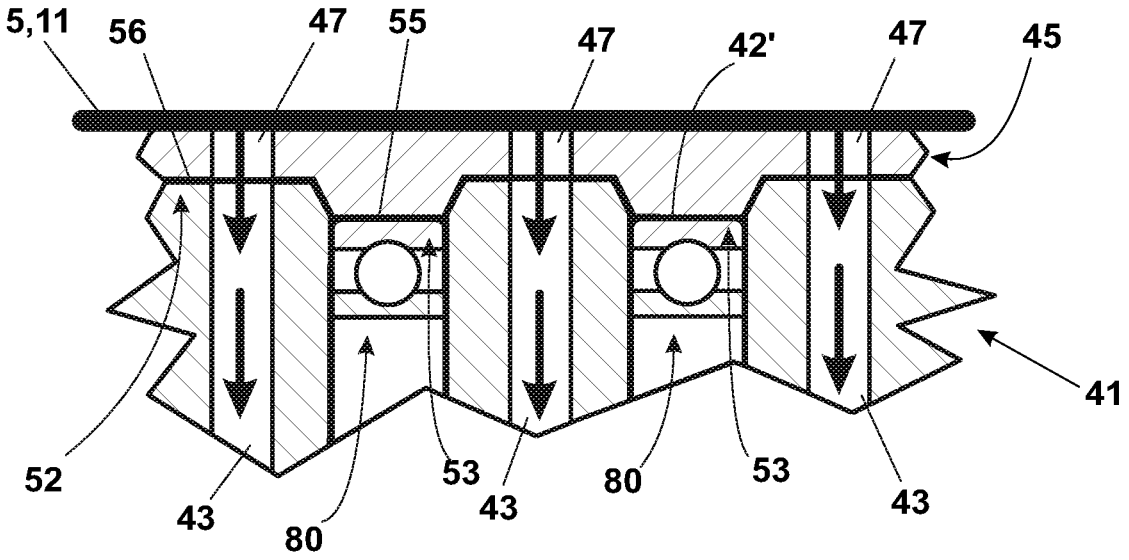
FIG. 12 shows a partial cross section of another embodiment of the conveying unit provided by the invention.

As diagrammatically shown in FIG. 12, at least one portion 42' of the surface 42 of support 41 can be the external surface of a bearing 80. In this way, at contact points of suction belt 45 with bearing 80, the friction is reduced substantially to zero. Notwithstanding in FIG. 12 bearings 80 are shown positioned at recesses 53, i.e. in contact with the surface of the teeth 55 of belt 45, they can also be positioned at the protrusions 52 of support 41, solution not shown for simplicity.

As shown in detail in FIGS. 8 and 9, the, or each, peripheral suction groove 43 extends for a length to define a suction portion 49 under a predetermined angular width α, for example set between 30° and 120°. The shape of support 41, under angle α, is shown as curvilinear, in particular circular, in FIGS. 8 and 9A, and as rectilinear in FIG. 9B, even though it could have a different shape, or it could be formed by a determined number of consecutive rectilinear segments.

Figure 10:
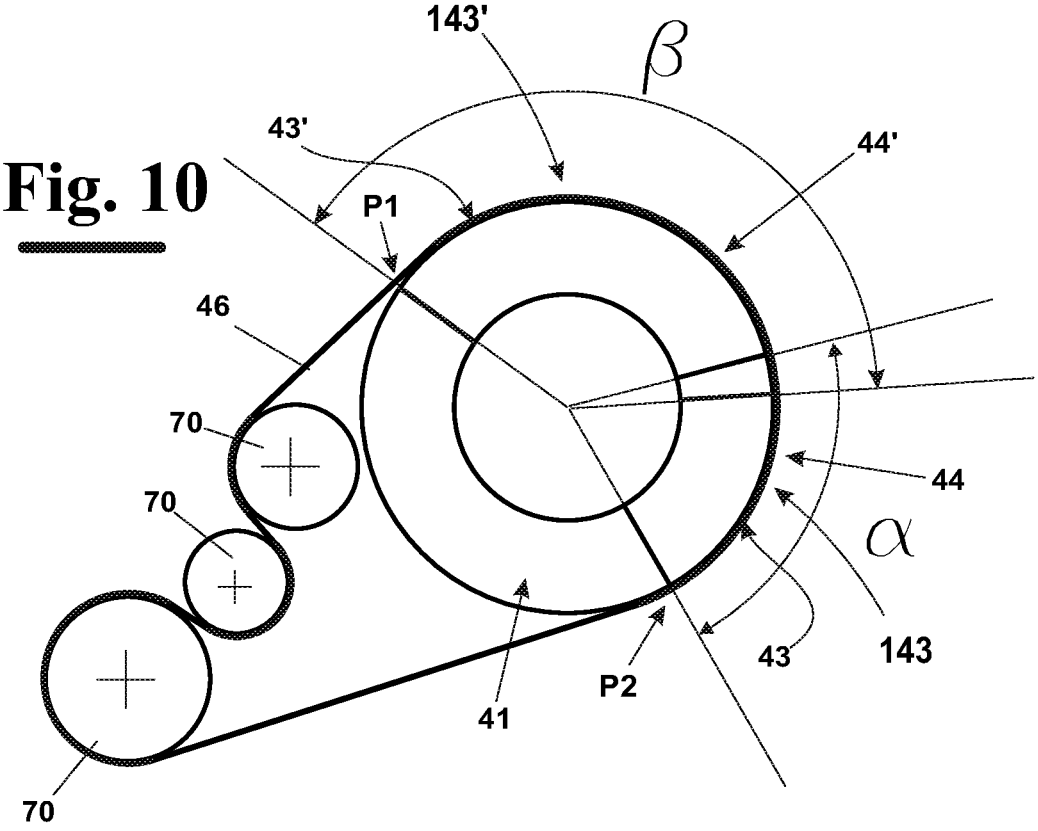
Figure 11:
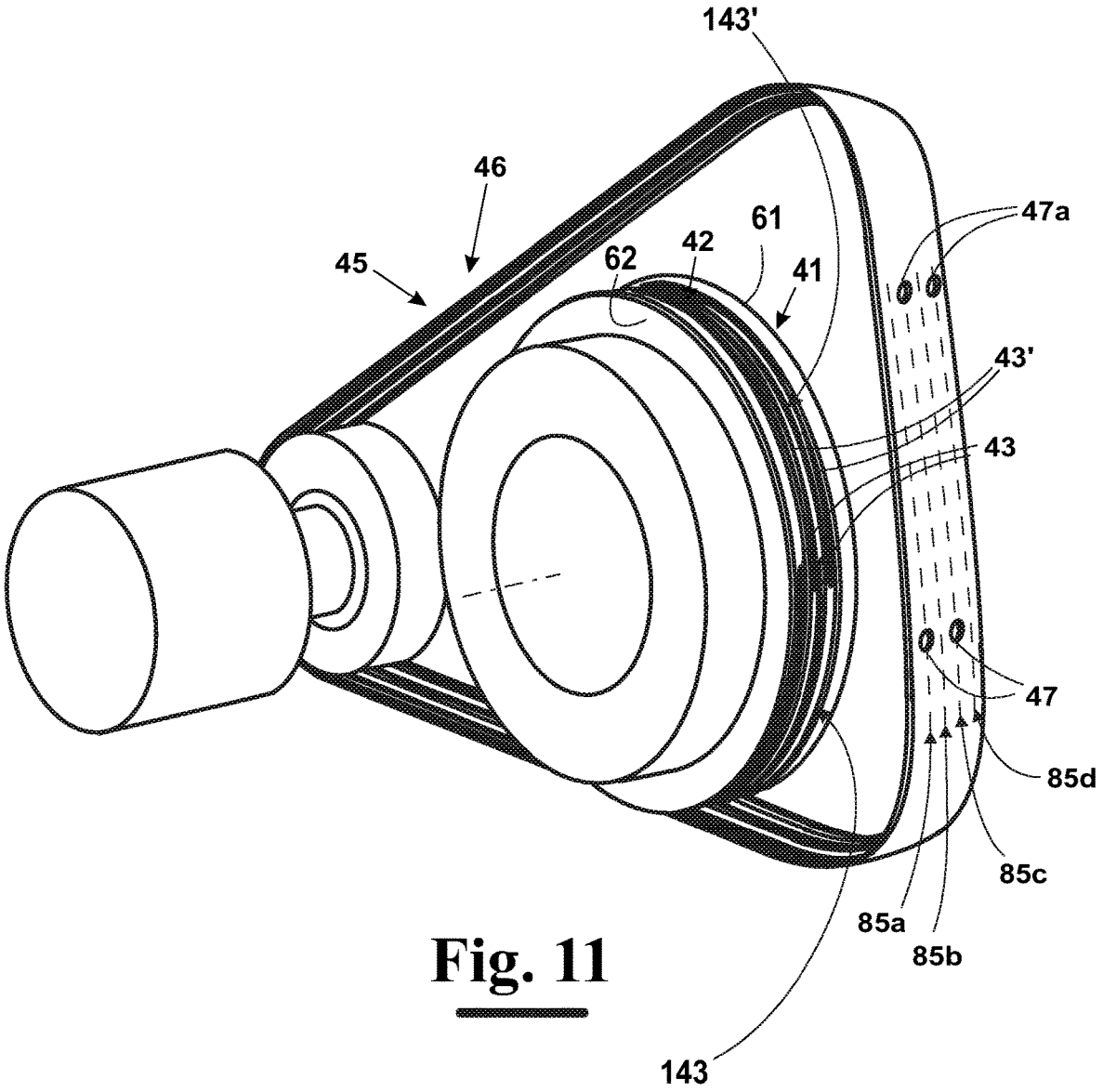
FIG. 11 shows a perspective side view of another embodiment of the conveying unit according to the invention.

In the alternative embodiment of FIGS. 10 and 11, support 41 can provide a first suction group 143' comprising at least one peripheral suction groove 43' positioned at a predetermined distance from the opposite ends 61 and 62 of support 41. More in detail, the first group of suction grooves 43' defines, on the surface of support 41, a first suction portion 44'. It is, then, provided a second suction group 143 comprising at least one suction groove 43 positioned at a different distance from ends 61 and 62 of the support, with respect to the peripheral suction groove 43' of the first group.

The first and the second suction group define on the surface 42, respective different, but partially overlapped to each other, suction portions 44' and 44 (FIG. 10).

In the case shown, for simplicity, in FIG. 11, support 41 has a substantially circular cross section. In this case, the peripheral grooves 43' of the first group and the peripheral grooves 43 of the second group are positioned at different circumferences. More in detail, the peripheral grooves 43' of the first group are arranged to cause a suction effect on web 5, or sheet 11, on the surface 42 of support 41 at the portion of the latter corresponding to a central angle β (see FIG. 10), whereas the peripheral grooves 43 of the second group are arranged to cause a suction effect on web 5, or sheet 11, for holding the same on surface 42 of support 41, at a portion corresponding to an central angle α. As shown in detail in FIG. 11, holes 47 of a row are shifted with respect to the holes 47*a* of the other row, i.e. they are positioned on belt 45 along different directions 85*a*-85*d*, and, furthermore, alternated to each other. The distance between holes 47 and 47*a* is about one panel length 12. In FIG. 11, a single row of holes 47, and a single row of holes 47*a*, are shown, even if it is clear that, since the distance between a row of holes 47 and the row of holes 47*a* is about one panel length and this distance is repeated the same for all the belt, further holes are provided on the belt which are not shown for simplicity.

Figure 13:
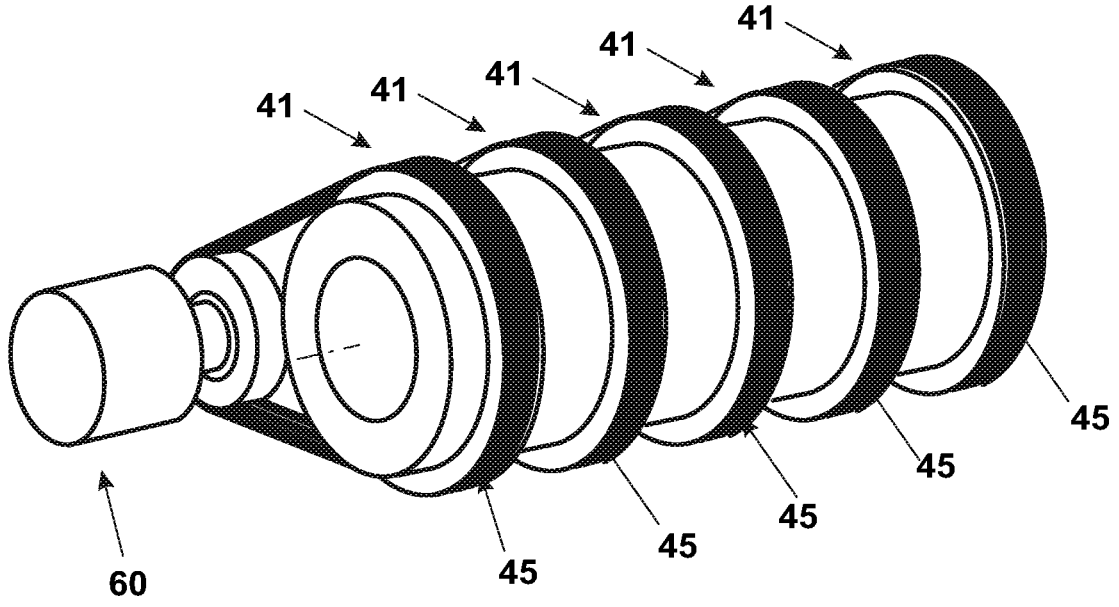
FIG. 13 shows a perspective side view of still another embodiment of the conveying unit according to the invention.

In FIG. 13 another alternative embodiment of the conveying unit 100 according to the invention is diagrammatically shown. In this case, the conveying unit comprises a plurality of supports 41, as above described, arranged coaxially to each other, in particular on a same support shaft. On each support 41 a respective belt 45 is arranged, as described with reference to FIGS. 1 to 12. The number of supports 41 and, therefore, of suction belts 45, that are used will depend, in particular, from the width of web 5, or sheet 11. Therefore, in this case, each suction belt 45 will be capable of causing a suction effect on a respective portion of a same processed sheet 11, or web 5, of paper, or similar products.

With reference to FIGS. 14 to 16, in an embodiment of the invention, a folding and stacking machine 1 comprises a folding, or interfolding, section, 40 arranged to form a stack 50 of folded or interfolded sheets. More precisely, the folding, or interfolding, section, 40 provides a first and a second support 41*a* and 41*b*, each of which associated to a respective suction belt 45*a* and 45*b*, with the characteristics above described with reference to FIGS. 1 to 13.

More in detail, as well known, the folding, or interfolding, section 40, is arranged for folding, or interfolding, a web of paper 5, or a plurality of sheets of paper 11, into a plurality of panels 12, according to a predetermined folding, or interfolding, configuration.

According to the invention, the folding, or interfolding, section, 40, in this case, comprises a first and a second support 41*a* and 41*b* facing each other at a central zone 140. With reference to what it is shown in FIGS. 1-13, and in FIGS. 14-16, the supports 41*a* and 41*b* have respective lateral surfaces 42*a* and 42*b* both provided with at least one peripheral suction groove 43*a* and 43*b* extending along the lateral surface for a predetermined length. More precisely, the, or each, peripheral suction groove 43*a* and 43*b* is pneumatically connected to an air suction system, for example comprising a vacuum pump 150, to define a corresponding suction portion 44*a* and 44*b* on lateral surface 42*a* and 42*b* of respective supports 41*a* and 41*b*. On each support 41*a* and 41*b*, a first and a second suction belt 45*a* and 45*b* is mounted arranged to move respectively along a first and a second closed trajectory 46*a* and 46*b*.

More precisely, the first and the second closed trajectory comprise, respectively, the above described suction portions 44*a* and 44*b* of the first and the second support 41*a* and 41*b*. More precisely, each suction belt 45*a* and 45*b* provides at least one through hole 47*a* and 47*b* which are arranged to be positioned at a respective suction groove 43*a* and 43*b* for causing a suction on the processed web 5, or on sheets 11.

The driving device 60 is arranged to move the belts 45*a* and 45*b* with respect to support 41*a* and 41*b*, respectively, in such a way that the through holes 47 of one, or the other, belt 45 are positioned at the central zone 140 shifted from each other. In this way, it is possible to cause a suction effect on the web, or the sheet, alternately, on the first, and on the second support 41*a* and 41*b*, for obtaining the desired folded or interfolded configuration.

As shown in the schematic representation of FIGS. 14, 15 and 16, machine 1 can further comprise a feeding section 10*a* and 10*b* arranged to feed at least one web of paper, at a predetermined conveying speed. The feeding section 10*a* and 10*b*, for example comprising a first and a second counter-rotating rollers (FIG. 14), is capable of feeding the web of paper 5*a* and 5*b*, respectively, directly to the folding, or interfolding, section, 40.

Between the feeding section 10*a* and 10*b* and the folding, or interfolding, section, 40, a perforating section 20'*a* and 20'*b* (FIG. 14), or alternatively, a cutting section 20*a* and 20*b*, can be provided. In FIGS. 15 and 16, the cutting section is diagrammatically represented with a block and is arranged to cause, in a known way, the cut of the webs of paper 5*a* and 5*b* into sheets 11 of desired length. The cutting section 20*a* and 20*b*, or the perforating section 20'*a* and 20'*b*, can feed the perforated web 5*a*, 5*b*, or the sheets 11, directly to the folding section 40 (FIG. 15). Alternatively, between the cutting section 20*a*, 20*b*, or perforating section 20'*a*, 20'*b*, a transfer section 30*a* and 30*b* can be provided, operating the transfer of the sheets 11 to the folding, or interfolding, section, 40 (FIGS. 14 and 16).

More in detail, in the case of the cutting section 20*a* and 20*b*, the web of paper 5*a* and 5*b* is directly divided into a plurality of sheets 11.

Instead, in the case of the perforating section 20'*a* and 20'*b*, the web of paper 5*a* and 5*b* is perforated along the perforation lines. The perforated web 5'*a* and 5'*b* is, then, divided into sheets 11, in the transfer section 30*a* and 30*b*, which is positioned downstream of the perforating section 20'*a* and 20'*b*, in a known way and, therefore, not described in detail.

In the examples of FIGS. 14, 15 and 16, the folding machine 100 is shown using the suction belts 45, as described with reference to FIG. 11. Notwithstanding the above, the folding machine 100 can provide, in general, any of the embodiments shown in Figs. from 1 to 13.

The foregoing description of specific exemplary embodiments will so fully reveal the invention according to the conceptual point of view, so that others, by applying current knowledge, will be able to modify and/or adapt in various applications the specific exemplary embodiments without further research and without parting from the invention, and, then it is meant that such adaptations and modifications will have to be considered as equivalent to the specific embodiments. The means and the materials to realise the different functions described herein could have a different nature without, for this reason, departing from the field of the invention. It is to be understood that the phraseology or terminology that is employed herein is for the purpose of description and not of limitation.

The invention claimed is:

1. A folding or interfolding machine comprising:

a folding, or interfolding, section, arranged to fold, or interfold, a web of paper, or a plurality of sheets of paper into a plurality of panels, according to a predetermined folding, or interfolding, configuration;

said machine wherein said folding, or interfolding, section, comprises:

a first and a second support facing each other in a central zone and having respective lateral surfaces provided with at least one peripheral suction groove extending on said lateral surface for a predetermined length, said, or each, peripheral suction groove pneumatically connected to an air suction system in such a way to define a corresponding suction portion on the lateral surface of the respective support;

a first and a second suction belt arranged to move respectively along a first and a second closed trajectory, said first and second closed trajectory comprising, respectively, said suction portions of said first and second support, said first and second suction belt configured to air-tightly engage with said suction portions and providing at least one through hole arranged to be positioned at a respective suction portion for causing a suction on said web, or said sheets;

a driving device configured to move said first and second suction belt with respect to said support, in such a way that said through holes of the first, or the second, belt are located at said central zone shifted from each other.

2. The folding or interfolding machine according to claim 1, wherein a feeding section is furthermore provided that is arranged to feed at least one web of paper and a predetermined conveying speed to said folding section.

3. The folding or interfolding machine according to claim 1, further comprising:

a cutting, or perforating, section, arranged to cut, or perforate, said, or each, web of paper into a plurality of sheets of predetermined length.

4. The folding or interfolding machine according to claim 1, further comprising:

a cutting, or perforating, section arranged to cut, or perforate, said, or each, web of paper into a plurality of sheets of predetermined length;

a transfer section arranged to transfer to said folding, or interfolding, section said plurality of sheets.

5. The folding or interfolding machine according to claim 4, wherein said transfer section comprises at least one transfer roller provided with holding members arranged to hold the cut sheets in said cutting section, and to directly transfer them to a folding, or interfolding, section.

6. The folding or interfolding machine according to claim 5, wherein said transfer section comprises, furthermore, at least a first and a second transfer belt, each transfer belt arranged to receive said sheets from said transfer roller, and to transfer them to a respective suction belt of the folding, or interfolding, section.

7. The folding or interfolding machine according to claim 1, wherein each suction belt provides a predetermined number of rows of through holes, wherein each row comprises a plurality of through holes.

8. The folding or interfolding machine according to claim 7, wherein the distance between two successive rows of through holes, namely the pitch of said rows of through holes, is substantially double the length of a panel of said sheets.

9. The folding or interfolding machine according to claim 1, wherein said first and second support provide a substantially circular cross section and said length of said, or each, peripheral suction groove is arranged to define a suction portion extending for a predetermined angular width $\alpha$ set between 30° and 120°.

10. The folding or interfolding machine according to claim 1, wherein each suction belt is a toothed belt comprising a plurality of teeth alternated to a plurality of recesses, said plurality of teeth and recesses arranged to engage with a respective plurality of recesses and protrusions made on the lateral surface of the respective support.

11. The folding or interfolding machine according to claim 1, wherein at least one portion of the surface of said, or each, support consists of an external surface of a bearing which is arranged to reduce the friction at contact points of said suction belt with said external surface of said bearing.

12. The folding or interfolding machine according to claim 1, wherein said, or each, peripheral suction groove is located at a respective protrusion of said lateral surface of said support.

13. The folding or interfolding machine according to claim 1, wherein each support comprises:

a first suction group comprising at least one peripheral suction groove positioned at a predetermined distance from ends of said support, said first suction group defining a first suction portion on said surface of said support;

a second suction group comprising at least one suction groove positioned at a different distance from ends of said support, with respect to said, or each, peripheral suction groove of said first group, said second suction group defining on said surface of said support a second suction portion different from said first suction portion, said first and second suction portions partially overlapped to each other.

14. The folding or interfolding machine according to claim 1, further comprising a storage housing wherein a plurality of suction belts can be stored having a different pitch, and a different distance between two successive rows of suction holes, said suction belts arranged to be selectively installed at said folding, or interfolding, section, in such a way to obtain panels of a length equal to a half of said pitch.

15. The folding or interfolding machine according to claim 1, wherein each of said supports is a fixed support.

16. A conveying unit of a web, or sheet, of paper, or similar products, arranged to transfer said web, or sheet, of paper, along a transfer direction of a paper converting machine, wherein said conveying unit comprises:

a support having a lateral surface provided with at least one peripheral suction groove extending for a predetermined length, said, or each, peripheral suction groove pneumatically connected to an air suction system, in such a way to define a corresponding suction portion at the lateral surface of the respective support;

a suction belt arranged to move along a closed trajectory comprising said suction portion, said suction belt configured to air-tightly engage with said suction portion and providing at least one through hole arranged to be positioned at a respective suction portion in order to cause a suction effect on said web, or sheet, and to transfer it from a first point to a second point of a production line of paper products, or linear products obtained starting from said web, or sheet;

a driving device configured to move said suction belt with respect to said support.

17. The conveying unit, according to claim 16, wherein at least one portion of the surface of said support consists of the external surface of a bearing which is arranged to reduce the friction at contact points of said suction belt with said external surface of said bearing.

18. The conveying unit, according to claim 16, wherein said support comprises:

a first suction group comprising at least one peripheral suction groove arranged at a predetermined distance from ends of said support, said first suction group defining a first suction portion on said surface of said support; a second suction group comprising at least one suction groove positioned at a different distance from ends of said support, with respect to said, or each, peripheral suction groove of said first group, said second suction group defining on said surface of said support a second suction portion different from said first suction portion, said first and second suction portions partially overlapped to each other.

19. The conveying unit according to claim 16, wherein each said support is a fixed support.

* * * * *